US006506129B2

(12) United States Patent
Chen

(10) Patent No.: US 6,506,129 B2
(45) Date of Patent: Jan. 14, 2003

(54) GOLF CLUB HEAD CAPABLE OF ENLARGING FLEXIBLE AREA OF BALL-HITTING FACE THEREOF

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 09/788,358

(22) Filed: Feb. 21, 2001

(65) Prior Publication Data

US 2002/0115501 A1 Aug. 22, 2002

(51) Int. Cl.[7] ..... A63B 53/04

(52) U.S. Cl. ..... 473/329; 473/342; 473/345; 473/350

(58) Field of Search ..... 473/324, 329, 473/342, 345, 346, 349, 350, 332

(56) References Cited

U.S. PATENT DOCUMENTS 3,652,093 A * 3/1972 Reuter
4,438,931 A * 3/1984 Motomiya
5,090,702 A * 2/1992 Viste
5,106,094 A * 4/1992 Desbiolles
5,176,384 A * 1/1993 Sata
5,460,371 A * 10/1995 Takeda
5,464,212 A * 11/1995 Cook
5,509,660 A * 4/1996 Elmer
5,755,627 A * 5/1998 Yamazaki
5,776,011 A * 7/1998 Su
5,830,084 A * 11/1998 Kosmatka
5,906,549 A * 5/1999 Kubica
5,931,746 A * 8/1999 Soong
5,971,868 A * 10/1999 Kosmatka
6,042,486 A * 3/2000 Gallagher
6,050,904 A * 4/2000 Kuo
6,348,013 B1 * 2/2002 Kosmatka

* cited by examiner

*Primary Examiner*—Sebastiano Passaniti
(74) *Attorney, Agent, or Firm*—Browdy and Neimark, P.L.L.C.

(57) ABSTRACT

A golf club head comprises a rear seat member and a front member fastened to the rear seat member by soldering. The two members are made of a metal material. The rear seat member has a base similar in shape to the back of the golf club head. The base has one side which is connected with a neck. The front member has a plate which is provided in the front face with a ball-hitting face. The plate is provided in the edge with an extension portion extending therefrom such that the rear edge of the extension portion is fastened with the front side of the base of the rear seat member by soldering. A flexure space is provided between the back of the plate and the rear seat member to facilitate the flexing of the plate.

12 Claims, 5 Drawing Sheets

GOLF CLUB HEAD CAPABLE OF ENLARGING FLEXIBLE AREA OF BALL-HITTING FACE THEREOF

FIELD OF THE INVENTION

The present invention relates generally to a golf club head, and more particularly to a golf club head capable of enlarging the flexible area of the ball-hitting face thereof.

BACKGROUND OF THE INVENTION

As shown in FIG. 1, a golf club head 90 of the prior art comprises a shell-like main body 91 and a ball-hitting plate 93 which is fastened to a front opening 92 of the main body 91. The plate 93 is fastened along the edge of the back side thereof by soldering with the edge of the opening 92. Now referring to FIG. 2, when the plate 93 hits a ball b, the plate 93 is caused to flex backward before returning to its original shape, thereby enhancing the ball-carrying capability of the golf club head 90 as well as prolonging the dwelling time. In light of the edge of the back side of the plate 93 being fixed, only the central area of the plate 93 is flexible. In other words, the flexibility of the ball-hitting plate 93 of the prior art golf club head 90 is rather limited. This is also true with the head of an iron golf club.

SUMMARY OF THE INVENTION

The primary objective of the present invention is to provide a golf club head capable of enlarging the flexible area of a ball-hitting face thereof. The extent of the flexibility of the face is enlarged at the time when the face hits a ball, thereby resulting in a greater resilient recovery force for carrying the ball farther. In addition, the dwelling time of the ball on the golf club head is so prolonged as to promote the ball-carrying capability and the ball controllability of the golf club head of the present invention.

The golf club head of the present invention comprises a rear seat member and a front member fastened to the rear seat member by soldering. The two members are integrally made of a metal material. The rear seat member has a base similar in shape to the back of the golf club head. The base has one side which is connected with a neck. The front member has a plate which is provided in the front face with a ball-hitting face. The plate is provided in the edge with an extension portion extending therefrom such that the rear edge of the extension portion is fastened with the front side of the base of the rear seat member by soldering. A flexure space is provided between the back of the plate and the rear seat member to facilitate the flexing of the plate.

DETAILED DESCRIPTION OF THE INVENTION

Figure 1:
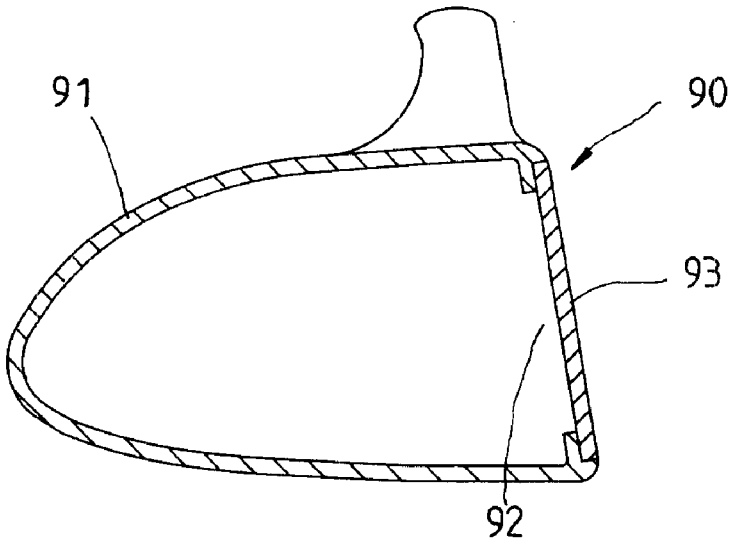
FIG. 1 PRIOR ART
FIG. 1 shows a side sectional view of a golf club head of the prior art.
Figure 2:
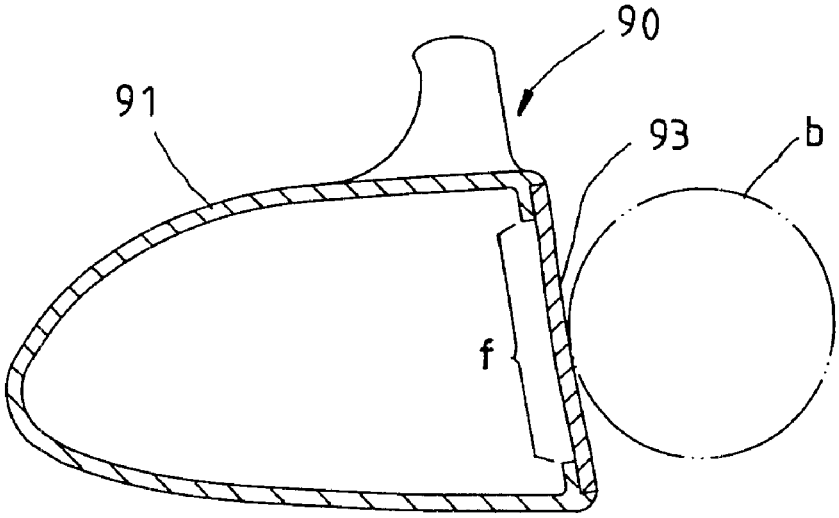
FIG. 2 PRIOR ART
FIG. 2 shows a schematic view of the prior art golf club head hitting a ball.
Figure 3:
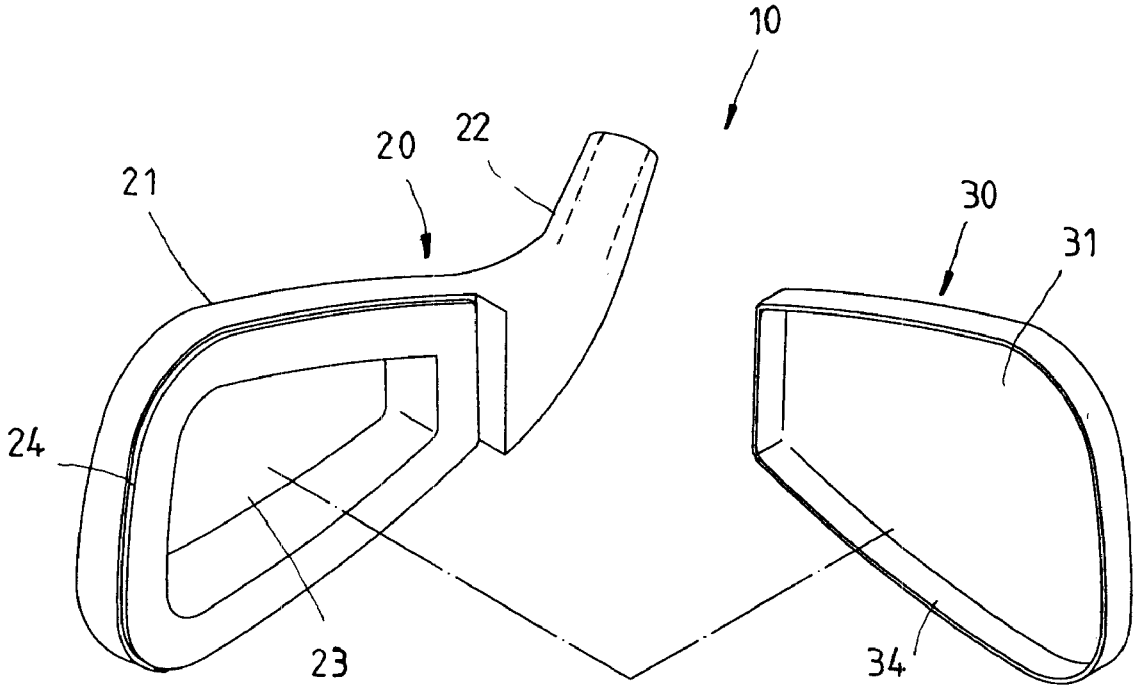
FIG. 3 shows an exploded view of an iron golf club head of a first preferred embodiment of the present invention.
Figure 4:
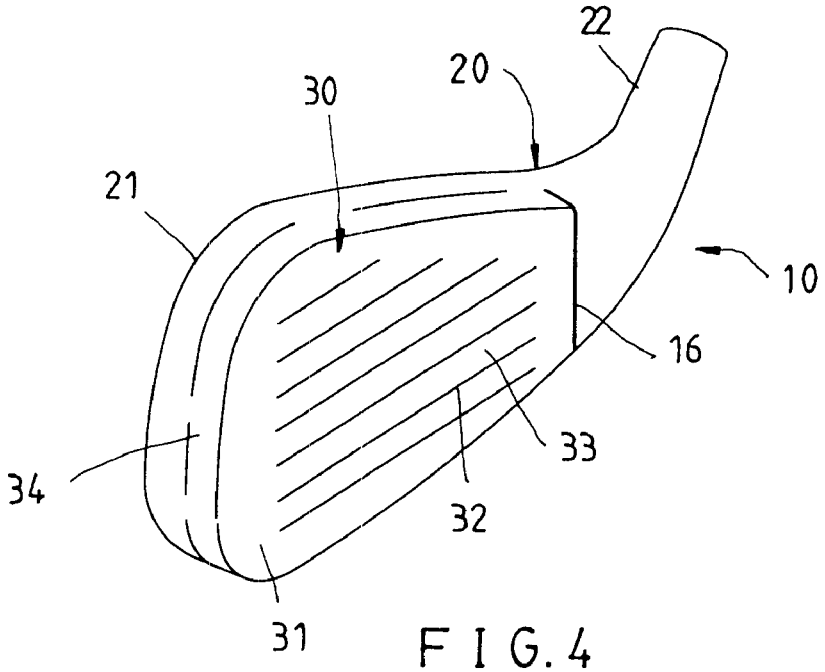
FIG. 4 shows a perspective view of the iron golf club head of the first preferred embodiment of the present invention in combination.
Figure 5:
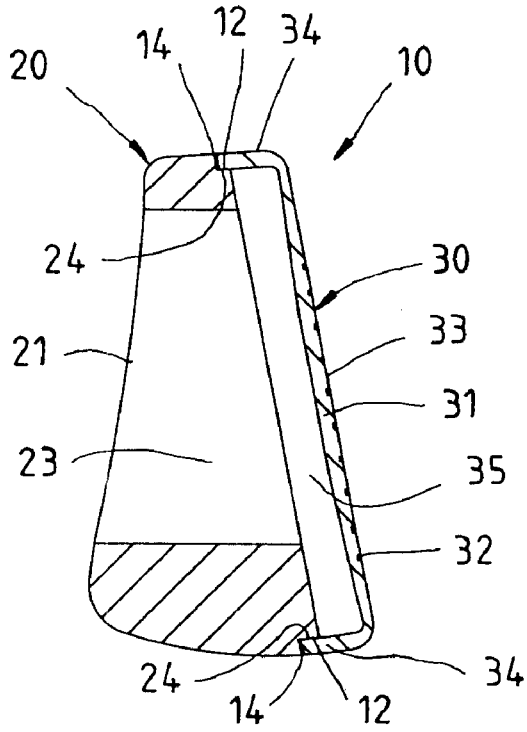
FIG. 5 shows a sectional view taken along a line 5—5 as shown in FIG. 4.

As shown in FIGS. 3–5, an iron golf club head 10 of the first preferred embodiment of the present invention is formed of a rear seat member 20 and a front member 30 fastened to the rear seat member 20 by soldering.

The rear seat member 20 is integrally made of a metal material, which is either ferrous or nonferrous. The rear seat member 20 has a base 21 similar in shape to the back of the iron golf club head, and a neck 22 connected to one side of the base 21. The base 21 is provided in the center with a cavity 23, which is optional and may or may not extend through the back of the base. The base 21 is provided in the front side with an annular insertion slot 24, which has a longitudinal linear section corresponding to one side of the neck 22, with other sections circumventing the edges of the base 21. The neck 22 has an insertion hole 25 extending from the top end thereof for fastening a golf club shaft.

The front member 30 is integrally made of a metal material, which is either ferrous or nonferrous. The front member 30 has a plate 31 similar in profile to the insertion slot 24. The plate 31 has a thickness ranging between 1.5 and 3.0 mm. If it is made of a ferrous material, it has a thickness ranging between 1.5 and 2.5 mm. If is made of a nonferrous material, it has a thickness ranging between 2 and 3 mm. The central portion is thicker than the edge, as shown in FIG. 5. The thickness may become smaller gradually from the center toward the perimeter of the plate 31. The thickness may also be such that plate 31 becomes thin abruptly at the perimeter of the plate. The plate 31 is provided in the front side with a plurality of grooves 32 forming a ball-hitting face 33. The plate 31 is further provided with an extension portion 34 extending rearward from the perimeter thereof.

The front member 30 covers the front side of the base 21 of the rear seat member 20 such that the rear end of the extension portion 34 is joined with the insertion slot 24 by soldering, and polishing if necessary. The soldering process involves the brazing of the two joining surfaces 12, the soldering of the two joining slits 14, or first brazing and then soldering. No matter which process is used, the adjoining place of the two members 30 and 20 is not joined together by soldering, thereby resulting in formation of an adjoining slit 16 in the front surface of the head 10, as shown in FIG. 4. The adjoining slit 16 has a predetermined width or no width at all. As shown in FIG. 5, the plate 31 of the front member 30 is not rested against the base 21 of the rear seat member 20 such that a flexure space 35 is formed between the back side of the plate 31 and the rear seat member 20. The flexure space 35 allows the plate 31 to flex rearwards.

Figure 6:
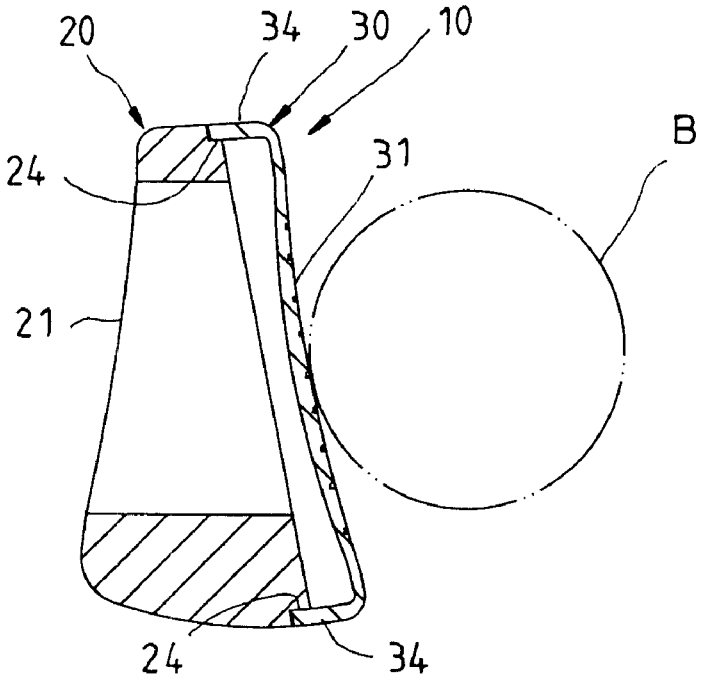
FIG. 6 shows a sectional view of the golf club head of the present invention upon hitting a ball.

As shown in FIG. 6, when the ball-hitting face 33 of the head 10 hits a ball, the thin plate 31 flexes rearwards in its entirety to bring about a greater resilient recovery force which accounts for a greater ball-carrying capability of the head 10. In addition, the dwelling time of the ball B on the ball-hitting face 33 is prolonged to enhance the ball controllability of the head 10. The rear seat member 20 is not joined by soldering with one side of the front member 30, with the one side being corresponding to the neck 22. As a result, the plate 31 is provided with a maximum flexibility. In addition, the plate 31 of the present invention has a thin fringe which promotes the rearward flexure of the plate 31.

Figure 7:
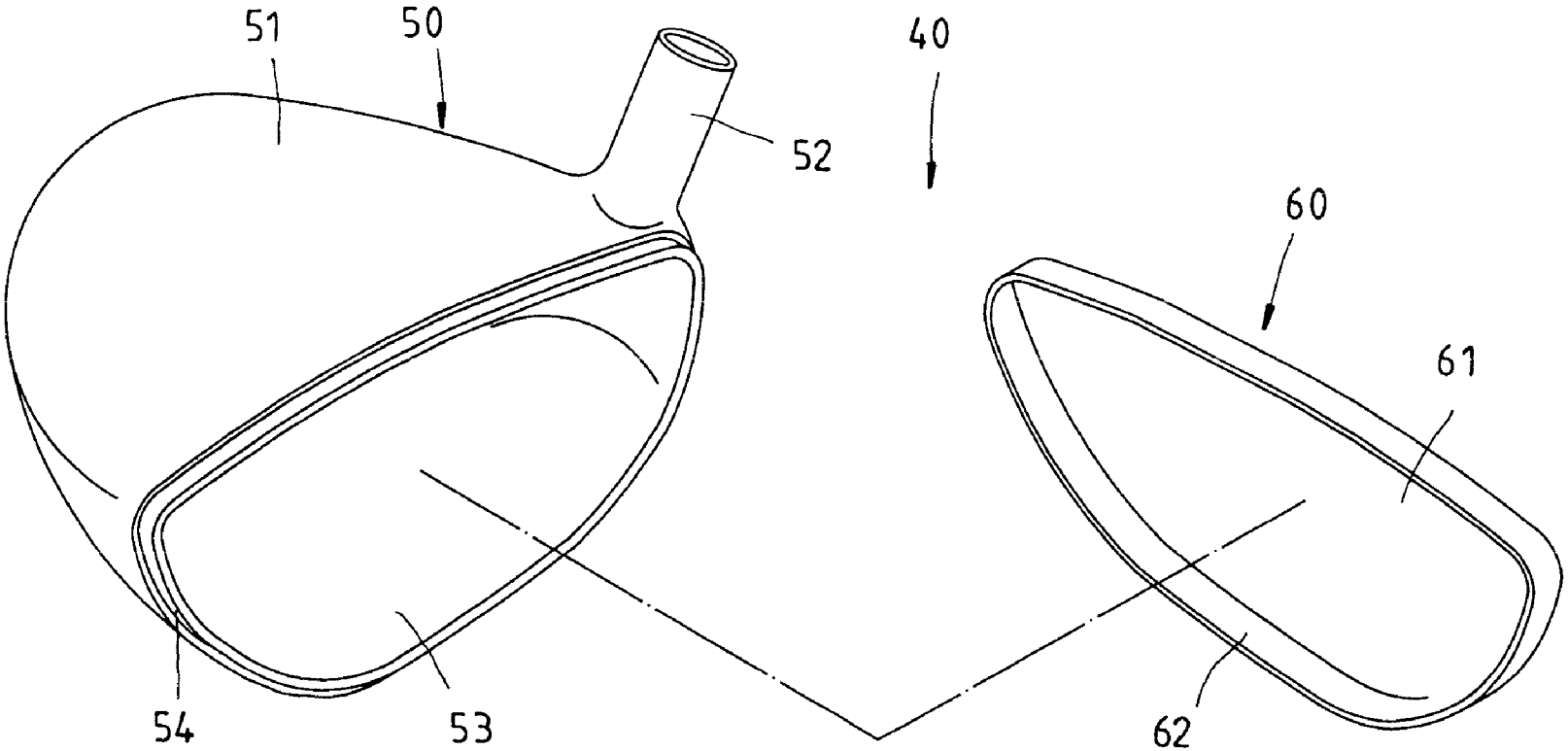
FIG. 7 shows an exploded view of a wooden golf club head of a second preferred embodiment of the present invention.
Figure 8:
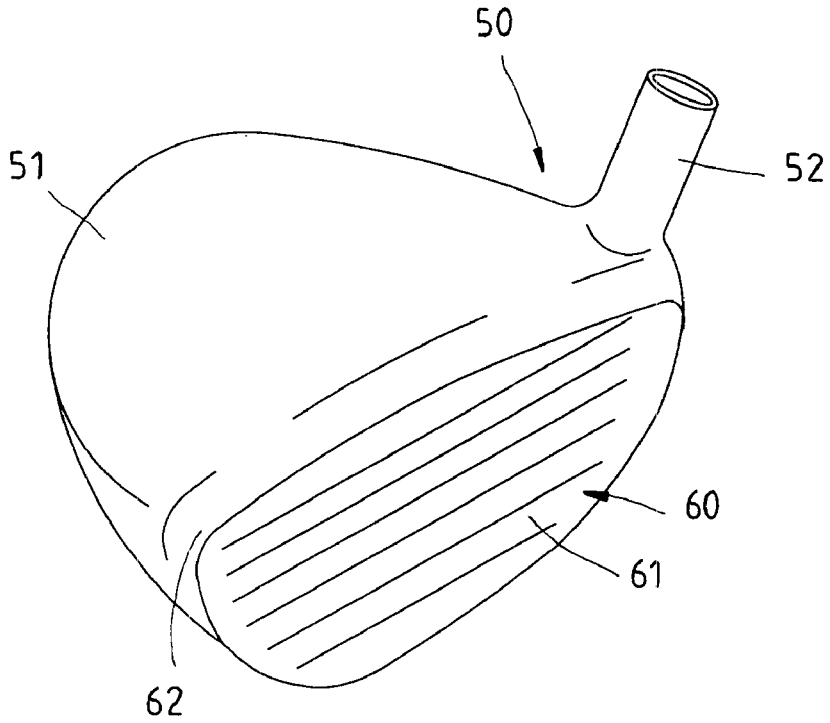
FIG. 8 shows a perspective view of the second preferred embodiment of the present invention in combination.
Figure 9:
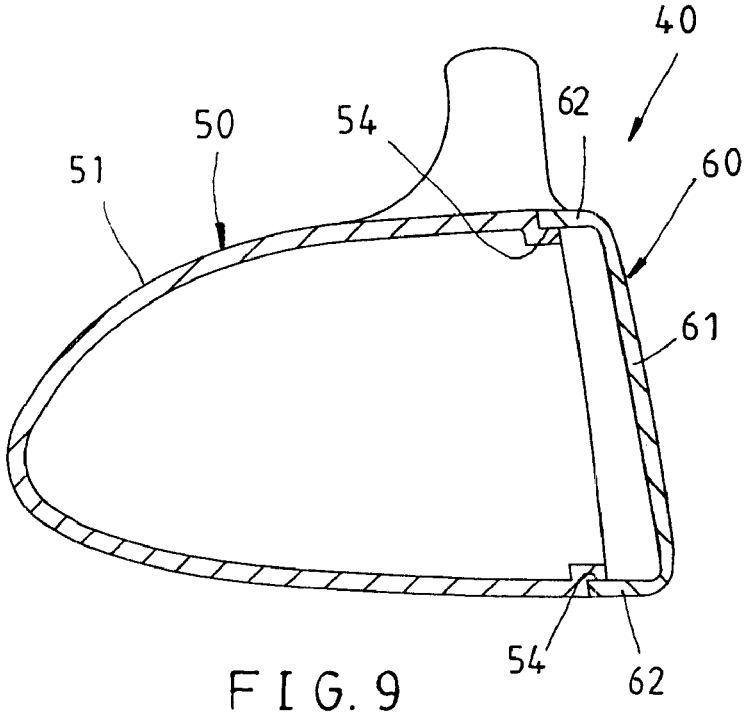
FIG. 9 shows a sectional view taken along a line 9—9 as shown in FIG. 8.

As shown in FIGS. 7–9, the golf club head of the present invention may be used in conjunction with a wooden golf club. The head 40 of the present invention is made of a metal material and is formed of a rear seat member 50 and a front member 60 fastened to the rear seat member 50 by soldering. The rear seat member 50 has a base 51 and a neck 52. The base 51 is of a shell-like construction and is provided in the front surface thereof with an opening 53, and in the outermost fringe thereof with a circular insertion slot 54. The front member 60 has a plate 61 and an extension portion 62 extending rearward from the edge of the plate 61. The plate 61 is corresponding in shape to the opening 53 of the rear seat member 50. The front member 60 covers the front surface of the rear seat member 50 such that the rear end of the extension portion 62 is received in the insertion slot 54, and that the back side of the plate 61 is separated from the front surface of the base 51 by a predetermined distance. The two members 50 and 60 are joined together by soldering to form a wooden golf club head. The plate 61 is the entire front surface of the wooden golf club head, whereas the extension portion 62 forms the side wall circumventing the front surface (ball-hitting face) of the head. As a result, the head 40 of the second preferred embodiment of the present invention is devoid of the adjoining slit 16 of the first preferred embodiment, which is located between the front member 60 and the rear seat member 50. The head 40 is provided with a greater flexure area to enhance the ball-carrying capability and the ball-controllability of the head 40. The base of the present invention may be devoid of the insertion slot extending along the edge of the base. The rear end of the extension portion is directly joined with the front face of the base by soldering.

What is claimed is:

1. A golf club head comprising a rear seat member and a front member joined with said rear seat member by soldering, said rear seat member and said front member being integrally made of a metal material, said rear seat member having a base with one side thereof being connected with a neck, said neck having an insertion hole for fastening a golf club shaft, said front member having a plate and an extension portion extending rearward from an entire perimeter of said plate, said plate having a front surface forming a ball-hitting face, said front member being joined with said rear seat member by soldering such that a rear edge of said extension portion is connected with the front side of said base of said rear seat member, a flexure space being formed between a full back surface of said plate and said rear seat member extending behind a central portion of the plate out to the extension portion along the entire perimeter of the plate, wherein a thickness of the plate of the front member out from the central portion thereof decreases toward the entire perimeter of the plate, and wherein the thickness of the plate decreases gradually toward the entire perimeter of the plate.

2. The golf club head as defined in claim 1, wherein said front member has an adjoining portion corresponding to one side of the neck; wherein said rear seat member has an adjoining portion corresponding to one side of the neck; wherein said adjoining portions are not joined together by soldering, thereby resulting in formation of an adjoining slit in a front face of the golf club head.

3. The golf club head as defined in claim 1, wherein said plate of said front member has a thickness ranging between 1.5 and 3.0 mm.

4. The golf club head as defined in claim 1, wherein said base of said rear seat member is provided in a front side with a circular insertion slot; wherein said extension portion of said front member is joined at the rear edge thereof with said insertion slot.

5. The golf club head as defined in claim 1 wherein said base of the rear seat member has a recess communicating with the flexure space.

6. The golf club head as defined in claim 5, wherein the recess extends through the rear seat member.

7. A golf club head comprising a rear seat member and a front member joined with said rear seat member by soldering, said rear seat member and said front member being integrally made of a metal material, said rear seat member having a base with one side thereof being connected with a neck, said neck having an insertion hole for fastening a golf club shaft, said front member having a plate and an extension portion extending rearward from an entire perimeter of said plate, said plate having a front surface forming a ball-hitting face, said front member being joined with said rear seat member by soldering such that a rear edge of said extension portion is connected with the front side of said base of said rear seat member, a flexure space being formed between a full back surface of said plate and said rear seat member extending behind a central portion of the plate out to the extension portion along the entire perimeter of the plate, wherein a thickness of the plate of the front member out from the central portion thereof decreases toward the entire perimeter of the plate, and wherein the thickness of the plate decreases abruptly at the entire perimeter of the plate.

8. The golf club head as defined in claim 7, wherein said front member has an adjoining portion corresponding to one side of the neck; wherein said rear seat member has an adjoining portion corresponding to one side of the neck; wherein said adjoining portions are not joined together by soldering, thereby resulting in formation of an adjoining slit in a front face of the golf club head.

9. The golf club head as defined in claim 7, wherein said plate of said front member has a thickness ranging between 1.5 and 3.0 mm.

10. The golf club head as defined in claim 7, wherein said base of said rear seat member is provided in a front side with a circular insertion slot; wherein said extension portion of said front member is joined at the rear edge thereof with said insertion slot.

11. The golf club head as defined in claim 7, wherein said base of the rear seat member has a recess communicating with the flexure space.

12. The golf club head as defined in claim 7, wherein the recess extends through the rear seat member.

* * * * *